US012304596B1

(12) United States Patent
Valm et al.

(10) Patent No.: US 12,304,596 B1
(45) Date of Patent: May 20, 2025

(54) INFLATABLE DECK PANEL WITH EMBEDDED FASTENERS

(71) Applicant: The United States of America as represented by the Secretary of the Navy, Newport, RI (US)

(72) Inventors: Nicholas A Valm, Dartmouth, MA (US); Paul V Cavallaro, Raynham, MA (US); Bryon A Nelson, Charlestown, RI (US)

(73) Assignee: The United States of America, as represented by the Secretary of the Navy

( * ) Notice: Subject to any disclaimer, the term of this patent is extended or adjusted under 35 U.S.C. 154(b) by 498 days.

(21) Appl. No.: 17/955,661

(22) Filed: Sep. 29, 2022

(51) Int. Cl.
*B63B 25/24* (2006.01)
*B63B 7/08* (2020.01)
*B63B 25/28* (2006.01)

(52) U.S. Cl.
CPC ..... *B63B 25/24* (2013.01); *B63B 7/08* (2013.01); *B63B 2025/285* (2013.01)

(58) Field of Classification Search
CPC ..... B63B 25/00; B63B 25/24; B63B 7/00; B63B 7/08; B63B 7/082; B63B 7/085; B63B 34/00
USPC ..... 114/75, 345
See application file for complete search history.

(56) References Cited

U.S. PATENT DOCUMENTS

| | | | | |
|---|---|---|---|---|
| 4,251,893 | A * | 2/1981 | McCrory | B63B 7/08 114/345 |
| 7,992,511 | B2 * | 8/2011 | Chon | B63B 7/08 114/345 |
| 11,401,008 | B2 * | 8/2022 | Cooper | B63B 7/08 |
| 12,006,007 | B2 * | 6/2024 | Steinhour | B63B 7/085 |

* cited by examiner

*Primary Examiner* — Lars A Olson
(74) *Attorney, Agent, or Firm* — James M. Kasischke; Michael P. Stanley; Jeffry C. Severson

(57) ABSTRACT

An inflatable drop stitch panel and method of use is provided with a plurality of rigid embedded fasteners inserted in apertures in the panel. In the method of use for the inflatable panel, the uninflated panel with embedded fasteners is placed on the deck of a surface ship and secured to deck fittings by tensioned lines. The panel is then inflated to operational pressure and equipment is secured to the panel using the embedded fasteners. The inflatable panel is a temporary structure and requires no permanent changes to the deck surface, such as drilling holes and welding fasteners.

11 Claims, 8 Drawing Sheets

INFLATABLE DECK PANEL WITH EMBEDDED FASTENERS

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is a method and apparatus to temporarily embed fasteners on the deck of a surface ship so that equipment can be secured on the deck.

(2) Description of the Related Art

Embedded fasteners are used on the decks of surface ships for equipment mounting. One type of embedded fastener is a deck socket having internal threads. Various equipment can be mounted by using the internally threaded sockets. A standard pattern of embedded fasteners increases the modularity of equipment mounting. One such standard grid pattern for embedded fasteners is a two-foot by two-foot grid pattern.

FIG. 1 illustrates a prior art top view of a portion of a surface ship deck 10 having a two-foot by two-foot grid pattern of embedded deck socket fasteners 12. A portable deck crane 14 and an A-frame 16 are secured to the deck 10 using the fasteners 12. Current implementations of the patterned embedded fasteners 12 are permanently welded into the frame of the ship surface.

The prior art of FIG. 2 illustrates a sectional view of embedded deck socket fasteners 12 in a portion of a deck 10. I-beams 18 are part of deck 10 prior to installation of fasteners 12. To install fasteners 12, a C-channel 20 is affixed to the bottoms of I-beams 12. Holes, openings or apertures, typically three inches in diameter, are drilled in the deck plate 10 and a C-channel 20.

A deck socket fastener 12 is then inserted in each aperture and welded at the top to the deck 10 and at the bottom to the C-channel 20. Standard deck socket fasteners have a three inch outside diameter with a socket of one inch diameter 8 UNC internal threads and two inches of thread engagement in the socket.

The manufacture of the standard grid pattern on the deck of a ship is time-consuming and may be difficult to accomplish, depending on the structure beneath the deck of the ship. Also, the standard grid pattern is a permanent structure that cannot be altered unless removed and rebuilt.

As such, a need exists for a simpler apparatus and method of installation for an embedded fastener pattern on a deck of a ship that requires no permanent changes to the deck surface. Permanent changes include drilling holes in the deck and welding fasteners in place.

BRIEF SUMMARY OF THE INVENTION

Accordingly, it is a primary object and general purpose of the present invention to provide an apparatus and method for positioning an embedded fastener pattern on the deck of a ship.

To attain the object of the invention, an inflatable panel for securing equipment on a ship deck is provided that includes a planar drop stitch panel having a woven top surface, a woven bottom surface and a plurality of drop yarns that connect the woven top surface to the woven bottom surface.

An elastomeric membrane is laminated to an outer plane of the woven top surface and to an outer plane of the woven bottom surface of the drop-stich panel to create an air-tight inflatable panel with top and bottom skins. The inflatable panel defines at least one aperture therein. Side walls are secured to and extend between the top and bottom skins around the at least one aperture.

A first tab of material is secured to the top skin around the top perimeter of the at least one aperture and a second tab of material is secured to the bottom skin around a bottom perimeter of the at least one aperture. A rigid fastener is disposed in each aperture and is secured to the first and second tabs of material. The rigid fastener defines a central opening therein with internal threads formed for receiving an externally threaded device.

In one embodiment, the air-tight panel defines a plurality of through holes or apertures therein. The inflatable panel includes side walls secured to and extending between top and bottom skins around each of the plurality of apertures. A first tab of material is secured to the top skin around a top perimeter of each of the apertures and a second tab of material is secured to the bottom skin around a bottom perimeter of each of the apertures.

A plurality of rigid fasteners are disposed in respective ones of the plurality of apertures and secured to the first tab and the second tab of material. Each rigid fastener defines a central opening therein with internal threads on the central opening for receiving an externally threaded device. The plurality of rigid fasteners can form a grid pattern on the inflatable panel.

A rigid bracing can extend across either the width or the length of the inflatable panel where the bracing is fixed to the panel with one or more rigid fasteners.

A method of using an inflatable panel to secure equipment on a deck of a surface ship includes placing the inflatable panel in an uninflated state at a desired location on the deck of the surface ship. The inflatable panel is secured in the uninflated state to the deck using tensioned lines secured at one end to embedded fasteners in the inflatable panel and at another end to deck fittings.

The inflatable panel is inflated to operational pressure and equipment is temporarily secured to the inflatable panel using the embedded fasteners in the inflatable panel. The deck can include a railing affixed to the deck with the inflatable panel at least partially secured to the railing by using the tensioned lines.

The method can further include the steps of uninstalling the equipment from the embedded fasteners, removing the equipment from the inflatable panel, deflating the inflatable panel, and untying and removing the inflatable panel from the deck.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

The invention includes an apparatus and method of use for creating an embedded fastener pattern on a deck of a ship that requires no permanent changes to the deck surface. More particularly, the apparatus includes a drop stitch inflatable panel with embedded fasteners situated in a grid pattern.

The invention includes a drop stitch fabric inflatable panel with at least one embedded insert. Drop stitch fabric panels are described in U.S. patent application Ser. No. 17/313,218 entitled "Soft-to-Hard Goods Connections with Dynamic Energy Dissipation" which is incorporated by reference herein.

For clarity, a method of embedding fastener inserts in a drop stitch fabric inflatable panel is described with respect to a single socket type fastener insert although numerous inserts can be used as long as the spacing between the inserts does not compromise the strength of the inflatable panel.

Figure 1:
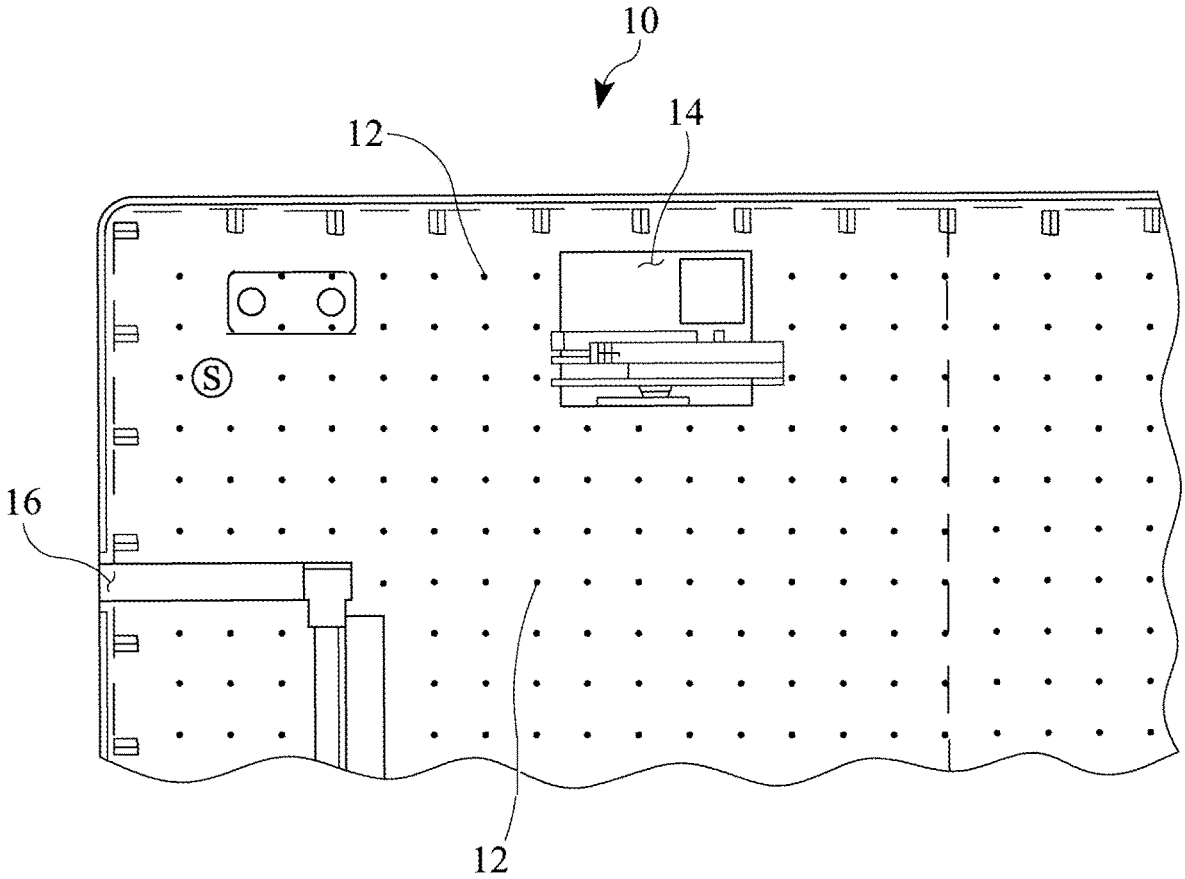
FIG. 1 PRIOR ART
FIG. 1 illustrates a prior art top view of a portion of a surface ship deck having a standard grid pattern of embedded fasteners.
Figure 2:
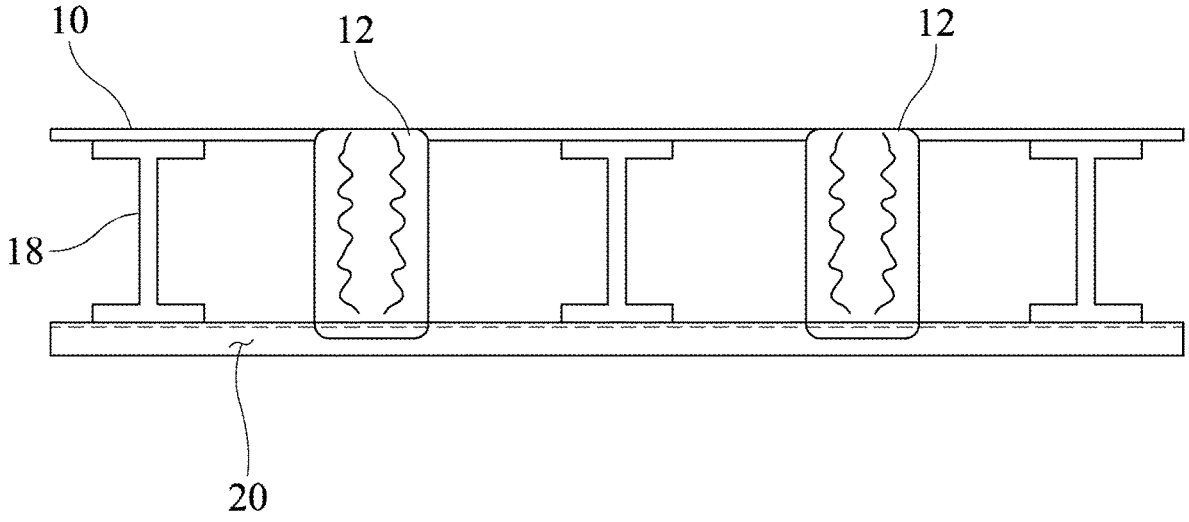
FIG. 2 PRIOR ART
FIG. 2 illustrates a prior art sectional view of embedded deck socket fasteners in a portion of a surface ship deck.
Figure 3:
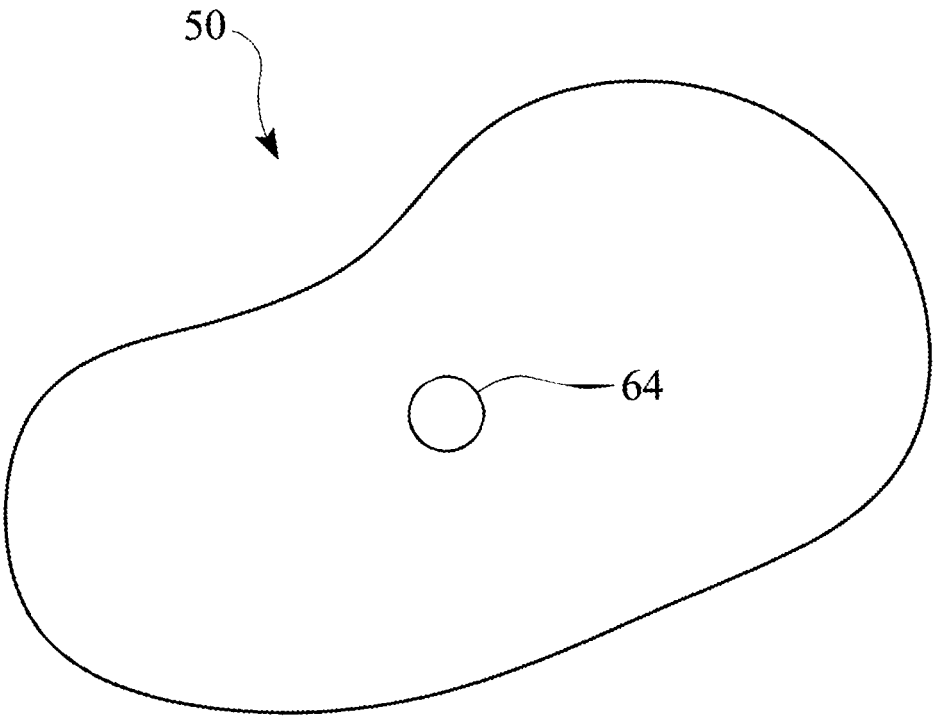
FIG. 3 illustrates a top view of a drop stitch inflatable panel with a through hole or aperture therein.
Figure 4:
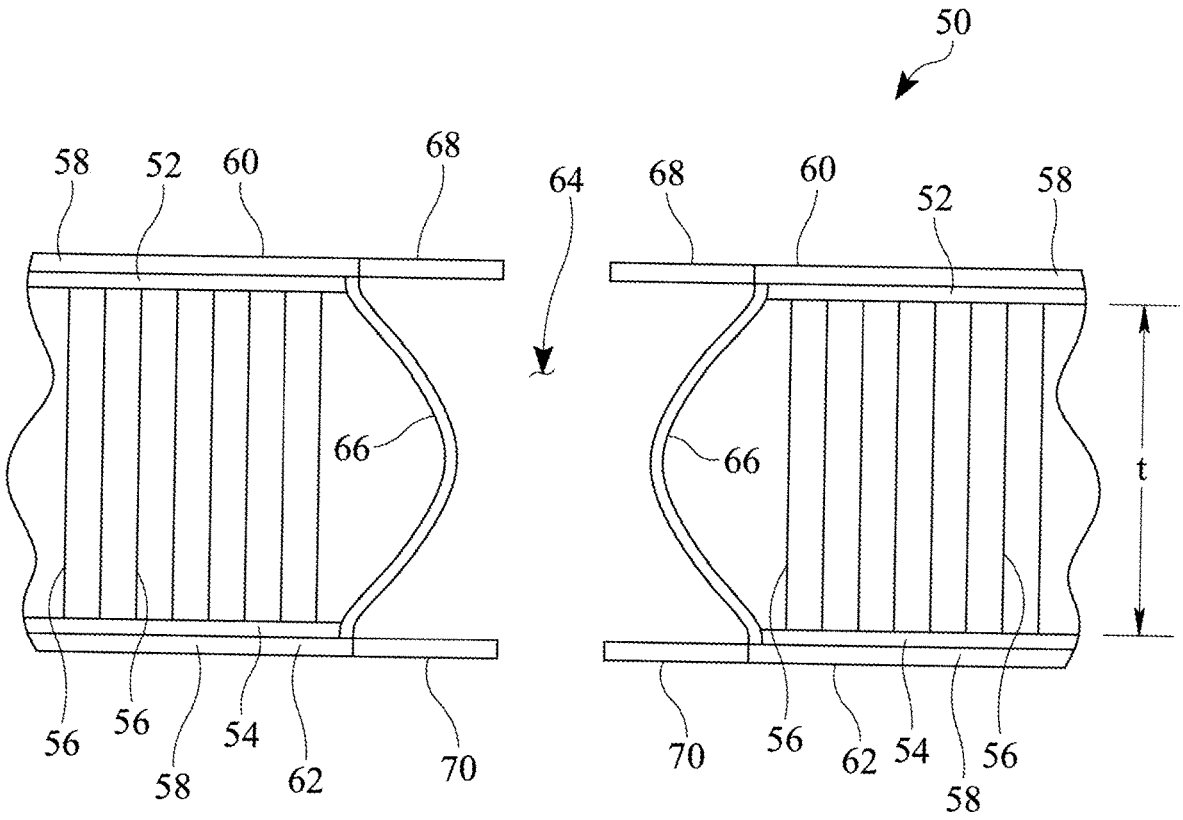
FIG. 4 illustrates a cross-sectional view of the drop stitch inflatable panel of FIG. 3.

FIG. 3 is a partial top view of a drop stitch inflatable panel 50 having an aperture 64 and FIG. 4 is a sectional view of the inflatable panel. The inflatable panel 50 may be any size or planar shape with a constant thickness "t".

The panel 50 includes a woven top surface 52, a woven bottom surface 54 and a plurality of drop yarns 56 that connect the woven top surface to the woven bottom surface. An elastomeric membrane 58 is laminated to outer planes of the woven top surface 52 and woven bottom surface 54 in order to provide a top skin 60 and a bottom skin 62 that form an air-tight volume in the panel 50.

When the panel 50 is in an uninflated state and for an initial installation, the aperture 64 is cut through the top skin 60 and the bottom skin 62 and material in the aperture is removed. Side walls 66 are affixed to the top skin 60 and the bottom skin 62 to seal the aperture 64 and to ensure an air-tight volume in the remainder of the panel 50. The side walls 66 may be soft or rigid and may be made of the same or different materials than the top skin 60 and the bottom skin 62.

The side walls 66 are secured the top skin 60 and the bottom skin 62 by adhesive bonding, radio frequency welding, stitching, or a combination of attachment methods. Whatever method is used for attaching the side walls 66; the side walls must maintain the air-tight volume in the panel 50.

A first tab 68 is secured to the top skin 60 around the circumference of the aperture 64 and a second tab 70 is secured to the bottom skin 62 around the circumference of the aperture. The first tab 68 and the second tab 70 are secured by adhesive bonding, radio frequency welding, stitching, or a combination of attachment methods.

Each tab 68, 70 is annular and can be made of the same material as the elastomeric membrane 58 or other suitable materials. A plurality of apertures 64 with side walls 66 and tabs 68, 70 may be formed in the panel 50 to create a desired grid pattern. The apertures 64 are where fasteners will be embedded and secured to the panel 50.

Figure 5:
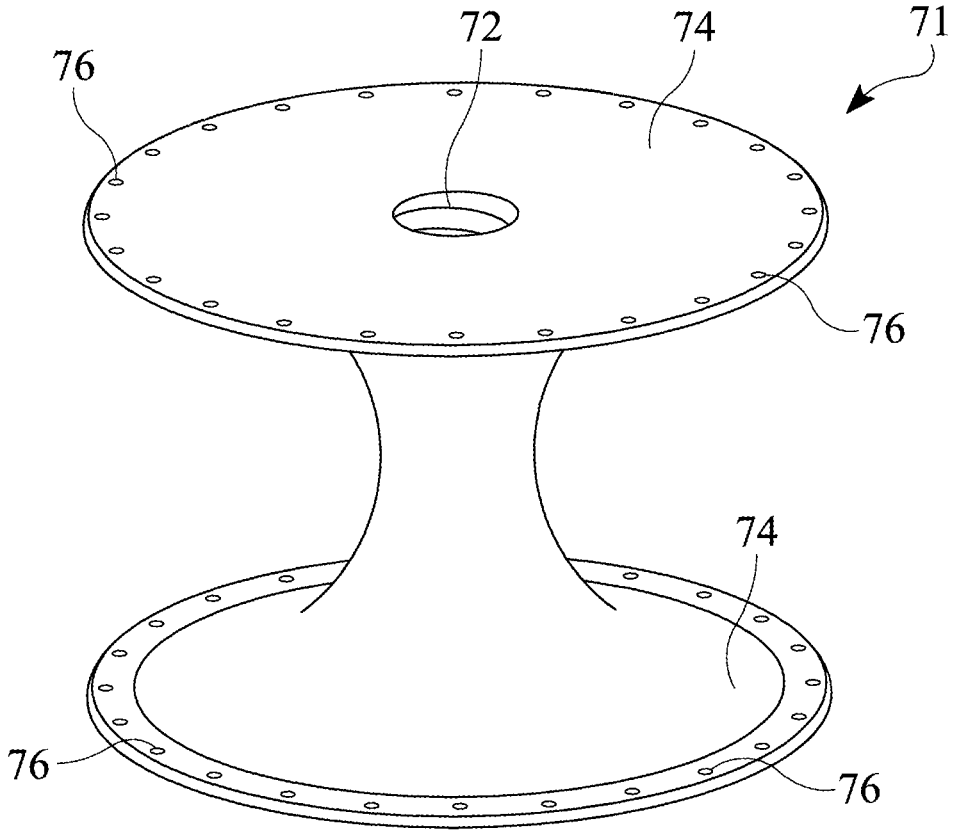
FIG. 5 illustrates a perspective view of one embodiment of a rigid socket fastener used in the present invention.
Figure 6:
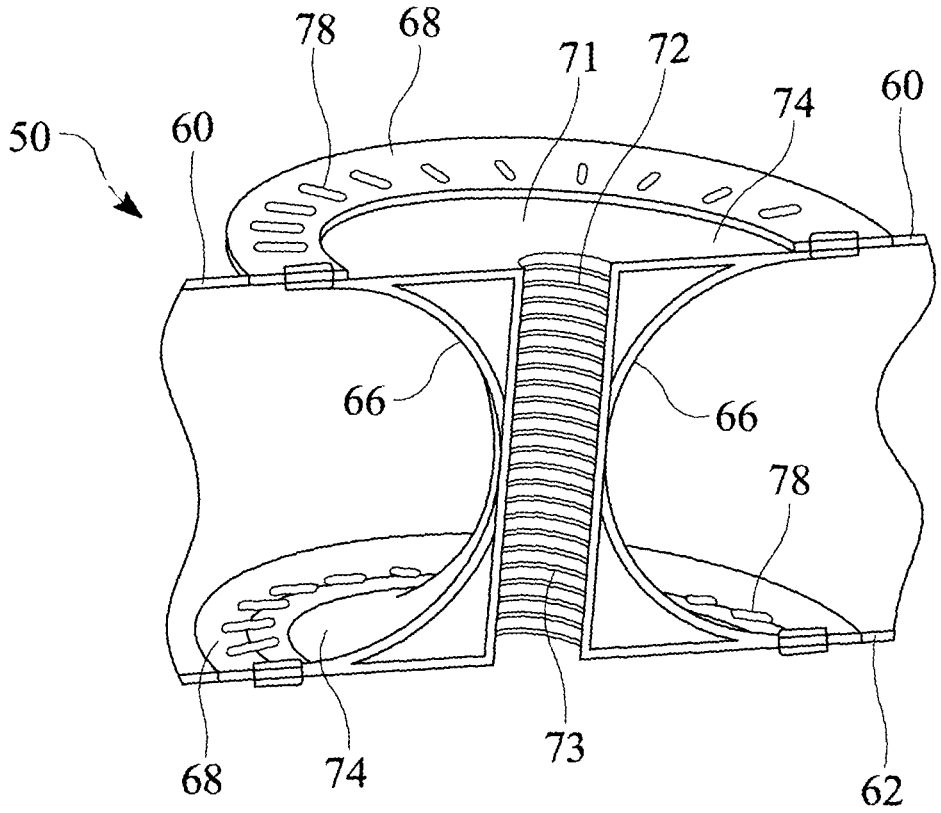
FIG. 6 illustrates a perspective sectional view showing a rigid socket fastener secured to a drop stitch inflatable panel.

FIG. 5 illustrates a perspective view of a rigid socket fastener 71 for insertion in an aperture 64 and for attachment to the panel 50. FIG. 6 illustrates a perspective sectional view showing the rigid socket fastener 71 secured to a drop stitch inflatable panel 50. The fastener 71 has a central aperture 72 with internal threads 73 and an hour glass shape with circular ends 74 for securing to the tabs 68, 70.

As shown in FIG. 5, the ends 74 include a plurality of circumferential openings or apertures 76 for receiving threads so that the fastener 71 can be sewed to the tabs 68, 70. The fastener 71 can also be fastened to the tabs 68, 70 using an adhesive or mechanical fasteners such as bolts.

The bolts would pass through openings or apertures in the tabs 68, 70 and openings in the circular ends 74 of the fastener 71. The bolts would be secured with nuts on the outer surface of the tabs 68, 70. In addition, a combination of methods can be used to secure the fastener 71 to the tabs 68, 70. Shapes other than an hour glass shape can be used for the socket type embedded fasteners.

In one embodiment, the fastener 71 embedded in the panel 50 complies with a standard for ship deck fasteners. Specifically, the central aperture 72 is one inch in diameter, internal threads 73 are 8 UNC internal threads and there are at least two inches of thread engagement in the central socket or aperture 72. Other embodiments of fasteners can have central holes or apertures with internal diameters and thread specifications.

Figure 7:
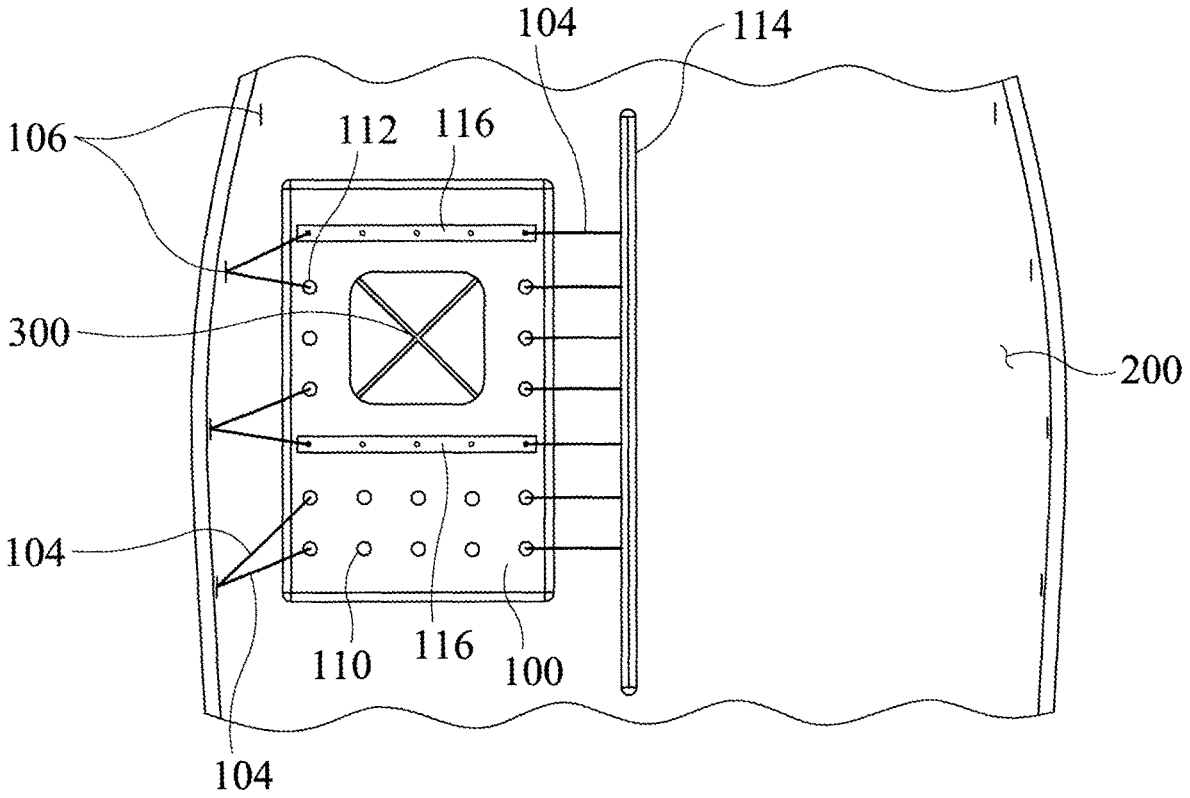
FIG. 7 illustrates a top view of a surface ship deck with a tied-down inflatable drop stitch panel having embedded fasteners.
Figure 8:
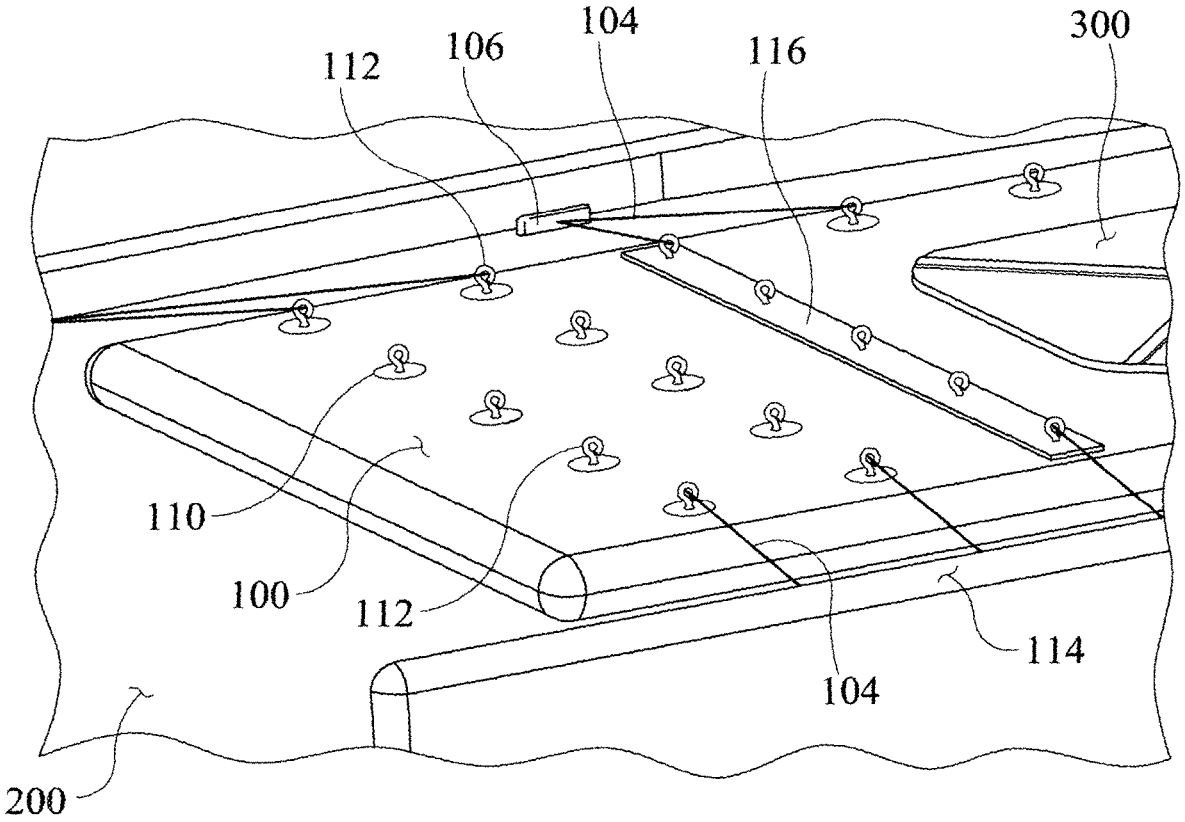
FIG. 8 illustrates a perspective view of a portion of FIG. 7.

FIG. 7 illustrates a top view and FIG. 8 illustrates a perspective view of a surface ship deck 200 with a tied-down inflatable deck panel 100 having embedded fasteners 110 and externally-threaded eye hooks 112 threaded into the fasteners. The inflatable deck panel 100 can be used by tying down the uninflated panel with tensioned lines 104 (such as straps, ropes, cables or the like) to deck fittings 106 (such as cleats, pad eyes, bitts, chocks, hooks or the like) secured to the ship deck 200.

The deck panel 100 is then inflated to operational pressure. Equipment 300 can be secured to the deck panel 100 with the hooks or eyes 112. A reverse process is used to retract or uninstall the deck panel 100 for stowage. The internally threaded embedded fasteners 102 can be used in combination with the externally threaded hooks, eyes 112 or with other externally threaded hardware.

An optional railing 114 affixed to the deck surface 200 can provide a tie-down point for the tensional lines 104. The railing 114 reduces tripping hazards because the tensional lines 104 (when used as tie-downs) do not need to span the width of the deck surface 200. The railing 114 can be a permanent structural member of deck 100 that exists unrelated to the inflatable deck panel 102.

If the railing 114 is absent on the deck 100, it may be worthwhile to permanently install a railing although the railing is not necessary for the function of the inflatable deck panels. If the railing 114 does not exist or is not capable of handling the loading of the tensional lines 104; then cleats, pad-eyes or the like can be used on both sides of the inflatable deck panel 100 to secure the panel to the deck 200.

The inflatable panel 100 may also include bracings 116 that span the width or length of the inflatable panel 100 with the bracings oriented longitudinally or transversely on the panel. The bracings 116 can be affixed to the panel 100 using the embedded fasteners 110 in the same manner as the temporary equipment 300 is affixed to the panel.

The bracings 116 may be made of steel or similarly hardened material in order to reinforce the inflatable deck panel 100 from bending loads. The bending loads can be caused by large moments that are generated by large, heavy equipment such as cranes or arches.

Advantages of the inflatable deck panels 100 include compact stowage, reduced weight and a reduced footprint on the host vessel. The inflatable deck panels 100 are temporary structures and require no permanent changes to the deck surface 200, such as conventional methods of drilling holes and welding fasteners.

If there is a need for a custom pattern of fasteners, those patterns can be designed using the inflatable deck panel 100 with embedded fasteners 110. The inflatable deck panels 100 provide a robust, stiff and versatile docking interface for temporary installation of surface deck equipment.

The inflatable deck panel 100 is customizable for length, width, thickness and appropriate bracings can be created to suit the dimensions of the panel. The threaded insert pattern can be changed for varying requirements.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An inflatable panel for securing equipment on a ship deck; said inflatable panel comprising:

a planar drop-stitch panel having a woven top surface, a woven bottom surface and a plurality of drop yarns connecting said woven top surface to said woven bottom surface between a first plane of said woven top surface and a first plane of said woven bottom surface;

an elastomeric membrane laminated to a second plane of said woven top surface opposite to said first plane of said woven top surface and laminated to a second plane of said woven bottom surface opposite to said first plane of said woven bottom surface to create a top skin on said second plane of said woven top surface and to create a bottom skin on said second plane of said woven bottom surface to ensure air-tightness of said inflatable panel;

a plurality of apertures extending through said top skin and said bottom skin;

at least one side wall secured to and extending between said top skin and said bottom skin around each of said plurality of apertures;

a first tab of material secured to said top skin around a top perimeter of each of said plurality of apertures;

a second tab of material secured to said bottom skin around a bottom perimeter of each of said plurality of apertures; and a rigid fastener disposed in each of said plurality of apertures and secured to said first tab and said second tab of said plurality of apertures, said rigid fastener defining a central aperture therein with internal threads formed on a surface of said central aperture to be capable of receiving an externally threaded device.

2. The apparatus of claim 1, wherein said plurality of apertures form a grid pattern on said inflatable panel.

3. The apparatus of claim 2, wherein said grid pattern is a two-foot by two-foot grid pattern.

4. The apparatus of claim 1, wherein said first tab and said and second tab are made of an elastomeric material.

5. The apparatus of claim 4, wherein said central aperture of each said rigid fastener is one inch in diameter, said internal threads on each said central aperture are 8 UNC internal threads and each said central aperture includes at least two inches of thread engagement.

6. The apparatus of claim 3, further comprising a rigid bracing that extends across a width of said inflatable panel, said rigid bracing being fixed to said inflatable panel via at least one of said plurality of rigid fasteners.

7. The apparatus of claim 3, further comprising a rigid bracing that extends across a length of said inflatable panel, said rigid bracing being fixed to said inflatable panel via at least one of said plurality of rigid fasteners.

8. A method of using an inflatable panel to secure equipment on a deck of a surface ship, said method comprising the steps of:

placing the inflatable panel in an uninflated state at a desired location on the deck of the surface ship;

securing the inflatable panel in the uninflated state to the deck using tensioned lines secured at one end to embedded fasteners in the inflatable panel and at another end to deck fittings;

inflating the inflatable panel to an operational pressure; and securing the equipment to the inflatable panel using the embedded fasteners in the inflatable panel.

9. The method of claim 8, wherein said step of securing equipment further comprises using externally threaded eye hooks threaded into the embedded fasteners.

10. The method of claim 9, wherein the deck includes a railing fixed to the deck and wherein said step of securing the inflatable panel includes at least partially securing the inflatable panel to the railing using the tensioned lines.

11. The method of claim 10, said method further including the steps of:

uninstalling the equipment from the embedded fasteners;

removing the equipment from the inflatable panel;

deflating the inflatable panel;

untying the inflatable panel; and removing the inflatable panel from the deck.

* * * * *